US007667154B2

(12) United States Patent
Dolinski

(10) Patent No.: US 7,667,154 B2
(45) Date of Patent: Feb. 23, 2010

(54) THREE-POSITION APPARATUS CAPABLE OF POSITIONING AN ELECTRICAL TRANSFER SWITCH

(75) Inventor: Walter Dolinski, Sayreville, NJ (US)

(73) Assignee: ASCO Power Tehnologies, L.P., Florham Park, NJ (US)

( * ) Notice: Subject to any disclaimer, the term of this patent is extended or adjusted under 35 U.S.C. 154(b) by 451 days.

(21) Appl. No.: 11/784,662

(22) Filed: Apr. 9, 2007

(65) Prior Publication Data

US 2008/0245645 A1 Oct. 9, 2008

(51) Int. Cl.
*H01H 5/00* (2006.01)

(52) U.S. Cl. ..... 200/400

(58) Field of Classification Search ..... 200/11 TC, 200/400, 401, 500, 501, 1 R, 17 R, 1 V, 50.32; 307/64, 112

See application file for complete search history.

(56) References Cited

U.S. PATENT DOCUMENTS 4,398,097 A * 8/1983 Schell et al. ..... 307/64
5,576,604 A * 11/1996 Kunert et al. ..... 318/135
5,638,948 A * 6/1997 Sharaf et al. ..... 200/401
6,534,737 B1 * 3/2003 Rademacher et al. ..... 200/401
6,538,223 B1 * 3/2003 Yoshida et al. ..... 200/401
6,765,157 B2 * 7/2004 Rademacher et al. ..... 200/1 R
6,815,624 B2 * 11/2004 Schultz ..... 200/50.33
6,849,811 B1 * 2/2005 Heflin et al. ..... 200/1 R
6,919,518 B2 * 7/2005 Rademacher et al. ..... 200/1 R
6,989,502 B1 * 1/2006 Lu ..... 200/401
6,995,327 B1 * 2/2006 Shepstone et al. ..... 200/50.32
7,402,766 B1 * 7/2008 Jonas et al. ..... 200/50.33

* cited by examiner

*Primary Examiner*—Michael A Friedhofer
(74) *Attorney, Agent, or Firm*—McDonnell Boehnen Hulbert & Berghoff LLP

(57) ABSTRACT

A multi-position apparatus for use with a system operated in at least three distinct positions. The apparatus comprises (i) a position-selection mechanism, (ii) a first link mechanism and a second link mechanism, each link mechanism being operably coupled with the position-selection mechanism, (iii) a first weight-actuated spring mechanism operably coupled with the first link mechanism, (iv) a second weight-actuated spring mechanism operably coupled with the second link mechanism, (vi) a first output-actuating member operably coupled with the first weight-actuated spring mechanism, the first output-actuating member being arranged to operably communicate with the system, and (vii) a second output-actuating member operably coupled with the second weight-actuated spring mechanism. In one example, the system may be an electrical transfer switch having two separate set of electrical contacts.

23 Claims, 8 Drawing Sheets

THREE-POSITION APPARATUS CAPABLE OF POSITIONING AN ELECTRICAL TRANSFER SWITCH

BACKGROUND

1. Field of the Invention

This invention relates generally to system transfer switches and, more particularly, to manually-operated electrical transfer switches.

2. Background of the Invention

Continuous, uninterrupted electrical power is often needed for the proper operation of electrically-powered equipment. This is especially true where the electrically-powered equipment, such as water pumps, fans, elevators, refrigeration and cooling systems (among others), is being used for a critical application. For instance, electrically-driven water pumps may need electrical power to supply water for fire fighting, cooling, sanitary use, or production processes. Refrigeration and cooling systems may need electrical power to maintain a temperature-controlled environment in order to operate temperature-sensitive equipment, keep food from spoiling, or even keep blood banks at a proper temperature. Similarly, elevators rely on electrical power to insure personal safety and provide proper operation during emergency situations.

Unfortunately, due to adverse weather conditions and/or other conditions, power failures may often occur. In the event of a power failure, an electrical load that is connected to a first power source (e.g., a utility power source) may need to be quickly transferred to another, alternate power source (e.g., a generator) to keep the load functional. For this purpose, the power industry has adopted the use of so-called "electrical transfer switches" that are often key components of emergency and standby systems. An electrical transfer switch is generally a device that transfers an electrical load from a "normal" power source to an "emergency" power source. During a load transfer from power source to another power source, electrical contacts of the switch are sequentially opened and closed to couple the load to a desired power source. In an open configuration, for example, the switch contacts may be positioned to disconnect the load from all power sources. In a closed configuration, the switch contacts may be positioned to connect the load to a given power source. For example, in a first closed configuration, the switch contacts may be positioned to connect the load to a normal power source. In a second closed configuration, the switch contacts may be positioned to connect the load to an emergency power source.

To control opening and closing of switch contacts, an electrical transfer switch will typically include an apparatus that is used to place the electrical transfer switch in a desired configuration. In one example, this apparatus may be automatically-actuated (e.g. electrically-actuated during a power failure). In another example, the apparatus may be manually-actuated, allowing a switch operator to manually toggle switch contacts so as to transfer an electrical load from one power source to another power source. In the case of a manually-operated electrical transfer switch, it is thus desirable to provide a manually-actuated apparatus that can efficiently transfer an electrical load from a one power source to another in order to prevent damage that may result from the load being without power.

Further, some electrical transfer switches come equipped with two separate sets of electrical contacts that each individually control a connection to a given power source. In this type of switch, one set of electrical contacts may be dedicated to selectively connecting the load to a first power source (e.g., a "normal" power source). Another set of electrical contacts may be then dedicated to making or breaking a connection with a second power source (e.g., an "emergency" power source). For instance, a so-called "dual-shaft" electrical transfer switch may have two separate moveable contact assemblies, typically in the form of two moveable shaft assemblies carrying a respective set of electrical contacts that can be open or closed as needed.

Certain manually-actuated mechanisms may only be capable of opening and closing a single set of switch contacts at a time. As a result, for the purpose of positioning a dual-shaft transfer switch for instance, a user may subsequently have to operate two separate mechanisms that each individually control a single set of switch contacts. Thus, a common manually-actuated apparatus capable of opening/closing two separate sets of contacts is needed for use with an electrical transfer switch, such as a dual-shaft electrical transfer switch.

In addition, unlike electrically-actuated switching mechanisms, current manually-actuated mechanisms having complex designs generally perform switching between sources in a manner that could create substantial periods where the load is disconnected from a power source. This detrimental behavior may result in part from the inability of a human user to quickly and accurately engage the switching mechanism so as to avoid delays in opening and closing electrical contact assemblies. Thus, it would be beneficial to provide a less complex manually-actuated mechanism that is capable of switching at an equivalent to that of an electrically actuated apparatus.

SUMMARY

In one embodiment of the invention, a three-position apparatus is provided for use with a system operated three positions. The three-position apparatus comprises: (i) a position-selection mechanism, (ii) a first link mechanism and a second link mechanism, each link mechanism operably coupled with the position-selection mechanism, (iii) a first weight-actuated spring mechanism operably coupled with the first link mechanism, (iv) a second weight-actuated spring mechanism operably coupled with the second link mechanism, (v) a first output-actuating member operably coupled with the first weight-actuated spring mechanism, the first output-actuating member being arranged to operably communicate with the system, and (vi) a second output-actuating member operably coupled with the second weight-actuated spring mechanism. The second output-actuating member arranged to communicate with the system, wherein the three-position apparatus is configured to position the system in distinct positions.

In another embodiment, the three-position apparatus may be advantageously used with an electrical transfer switch, and in particular, with an electrical transfer switch having two separate sets of electrical contacts. One example of such a switch may be a dual-shaft electrical transfer switch having a first moveable contact-shaft assembly and a second moveable contact-shaft assembly.

According to a preferred arrangement, the three-position apparatus comprises: (i) a position-selection mechanism, (ii) a first link mechanism and a second link mechanism, the link mechanisms operably coupled with the position-selection mechanism, (iii) a first weight-actuated spring mechanism coupled with the link mechanism, (iv) a second weight-actuated spring mechanism coupled with the link mechanism, (v) a first output-actuating member operably coupled with the weight-actuated spring mechanism, the first output-actuating member being arranged to operably communicate with the switch such as to actuate opening and closing of a first set of electrical contacts of the switch. A second output-actuating member coupled with the second weight-actuated spring mechanism, the second output-actuating member being arranged to operably communicate with the switch such as to actuate opening and closing of a second set of electrical contacts of the switch. The three-position apparatus is configured to position the switch in distinct positions.

BRIEF DESCRIPTION OF THE DRAWINGS

FIG. 5 illustrates a side view of the disclosed three-position apparatus in accordance with an;

DETAILED DESCRIPTION

1. Apparatus Structure

Figure 1:
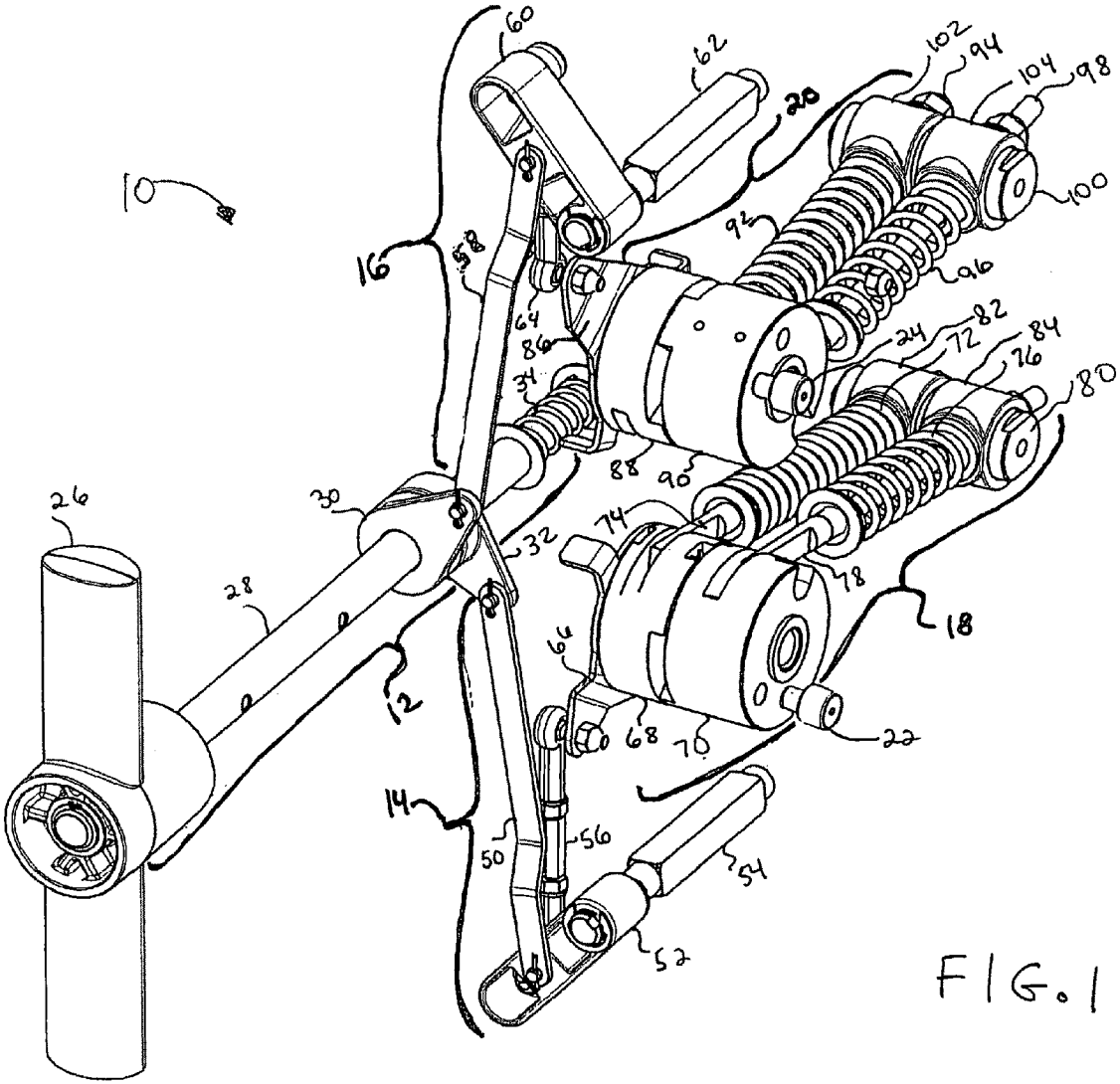
FIG. 1 illustrates a perspective view of a disclosed three-position apparatus, according to a preferred arrangement.

FIG. 1 is a perspective view of a three-position actuator 10 according to an illustrative embodiment of the invention. The three-position actuator 10 generally comprises three separate mechanical systems that may be used to drive a dual-switch system: a position-selection mechanism 12, weight-actuated spring mechanisms 18 and 20, and link systems 14 and 16. Through the interaction of these separate systems, a user may operate the three-position actuator 10 to control a dual-switch system via output-actuating members 22 and 24, as follows: position-selection mechanism 12 can be used to selectively engage either link system 14 or link system 16; and link system 14 drives weight-actuated spring mechanism 18 (and output-actuating member 22), while link system 16 drives weight-actuated spring mechanism 20 (and output-actuating member 24). Thus, when the position-selection mechanism 12 is positioned to operate link system 14, a user can drive output-actuating member 22; similarly, when the position-selection mechanism 12 is positioned to operate link system 16, a user can drive output-actuating member 24. Separate and more specific descriptions of each of the three systems (the position selection mechanism 12, link systems 14 and 16, and weight-actuated spring mechanisms 18 and 20) are provided below.

A. Position-Selection Mechanism Structure

Figure 2:
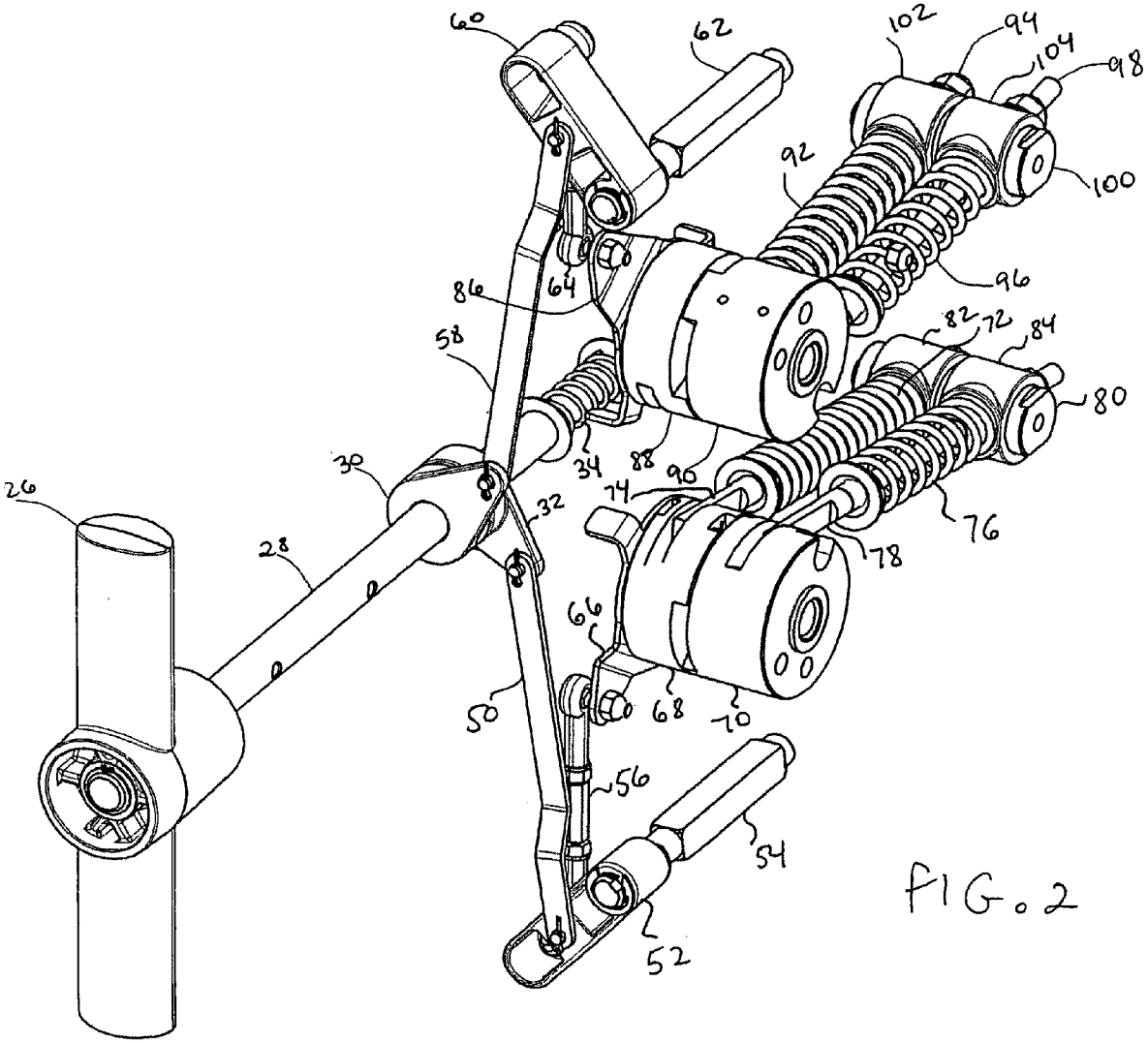
FIG. 2 illustrates another perspective view of the disclosed three-position apparatus.

As shown in FIGS. 1 and 2, position-selection mechanism 12 may include a manually-actuated means comprising an operating handle 26 attached to a handle shaft 28. Also attached to the handle shaft 28 may be a positioning yoke (positioning plate) 30 and a positioning yoke (positioning plate) 32, where positioning yokes 30 and 32 rotate about an axis defined by the handle shaft 28. Handle shaft 28 may be rotated in both clockwise and counterclockwise directions by turning operating handle 26 clockwise or counterclockwise (in the plane perpendicular to handle shaft 28). Similarly, handle shaft 28 may be moved in forward and backward directions by pushing or pulling operating handle 26 (in the plane of the handle shaft). Further, in one arrangement, the position-selection mechanism 12 may additionally include a biasing spring 34 that may assist in positioning the operating handle in a pulled-out position, as further described below.

Figure 3:
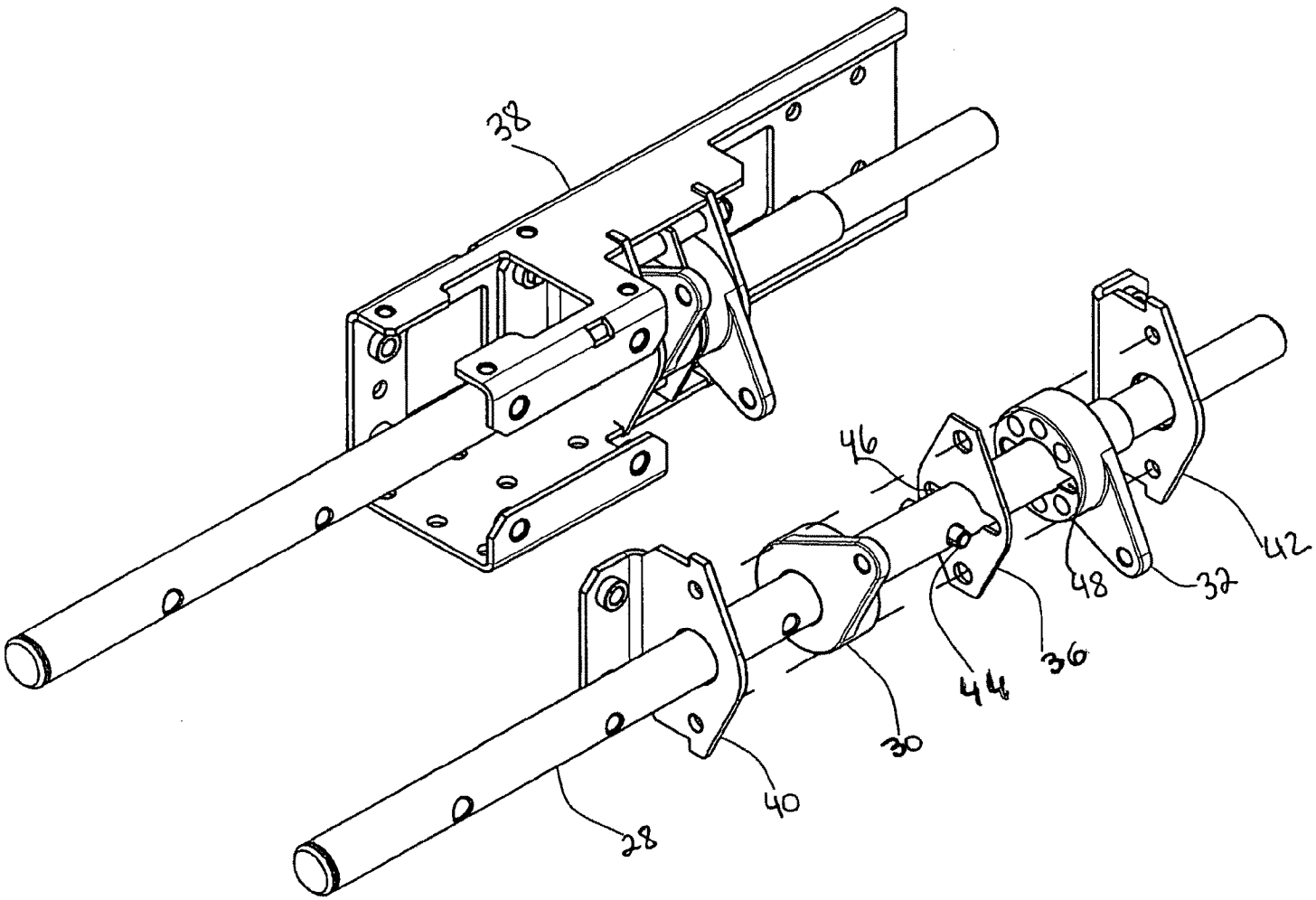
FIG. 3 illustrates perspective and exploded views of a representative position-selection means.

Referring now to FIG. 3, the position-selection mechanism 12 may further include an intermediate plate 36 disposed between positioning yokes 30 and 32, where plate 36 is attachable to a shaft frame 38. Intermediate plate 36 may include a slot 46 that permits the passage of a pin 44. In addition and as further described below, intermediate plate 36 and pin 44 act to provide a locking mechanism to prevent the three-position apparatus from entering into a state in which both output-actuating members 22 and 24 are set to an active, or "closed," state. To hold handle shaft 28 in place, two bearing plates 40 and 42 may be provided, each preferably mounted to the shaft frame 38. In addition, attached to handle shaft 28 may be pin 44, which can selectively engage positioning yokes 30 and 32. More particularly, as the handle shaft is pushed in through slot 46 and toward positioning yoke 32, pin 44 may engage positioning yoke 32 via a slot 48. Similarly, as the handle shaft is pulled out through slot 46 and toward positioning yoke 30, pin 44 may engage positioning yoke 30 via a slot (not shown) in positioning plate 30. Therefore, a user may selectively engage and actuate the first link system 14 generally by first pushing and then rotating the operating handle 26. Similarly, a user may selectively engage and actuate the second link system 16 generally by first pulling and then rotating the operating handle 26. Further, because pin 44 is affixed to handle shaft 28, intermediate plate 36 regulates the forward and backward motion of the handle shaft 28 by requiring proper orientation of the pin 44 with slot 46 in intermediate plate 36.

B. Link System Structure

As further shown in FIGS. 1 and 2, first link system 14 is designed such that, when selectively engaged with the position-selection mechanism 12, the rotational motion of the operating handle 26 is converted to the rotational motion of a first input weight actuation plate 66. Conversion of the rotational motion of the operating handle 26 to the rotational motion of first input weight actuation plate 66 is achieved through a series of mechanical links and levers in the first link system, as further described below. Similarly, second link system 16 is designed to convert rotational motion of the operation handle 26 to the rotational motion of second input weight actuation plate 86. Therefore, second link system 16 may contain similar elements in a similar arrangement to that of first link system 14. However, those of ordinary skill in the art will recognize alternative type structures could also be used.

First link system 14 may include a link 50 for mechanically coupling positioning yoke 32 to lever 52, such that rotation by the positioning yoke 32 about the handle shaft axis actuates lever 52. Lever 52 pivots about a fixed shaft 54 at one end, and is coupled to a link assembly 56 at the other end. Link assembly 56 may be attached to lever 52 at one end, and to actuation plate 66 at an opposite end. The connection between link assembly 56 and actuation plate 66 may serve to mechanically couple first link system 14 to first weight-actuated spring mechanism 18. As noted above, second link mechanism 16 may include substantially the same components as first link mechanism 14. However, those of ordinary skill in the art will recognize alternative type structures could also be used. Accordingly, second link mechanism 16 may include a link 58 for attaching to positioning yoke 30, a lever 60 that connects to link 58 and rotates with a shaft 62, and a link assembly 64 for attaching to action plate 86 in second weight-actuated spring mechanism 20.

Generally, first and second weight-actuated spring mechanisms 18 and 20 are designed such that, after a user initiates a change in position, the weight-actuated spring mechanisms self-completes the transition into the new position. More specifically, where the output-actuating members 22 and 24 can each be maintained in two states (e.g., an "open" and a "closed" state), the first and second weight-actuated spring mechanisms 18 and 20 are designed such that when a user operates the three-position actuator to move one of the output-actuating members from one state to another, only an initial portion of the switch from the first state to the second state (up to an "activation point") is achieved through a translation of the user's rotation of the operating handle 26 into movement of the first or second weight-actuated spring mechanism; the remaining portion of the switch from the first state to the second state (after the activation point has been reached) is achieved automatically through the transference of stored mechanical energy into the rotational movement of weighted cams. This automatic transference of stored mechanical energy into rotational movement aids the three-position actuator in performing switching functions at rates comparable to those achieved through electrically-activated systems.

C. Weight-Actuated Spring Mechanism Structure

As noted above, link mechanisms 14 and 16 will be preferably attached to respective weight-actuated spring mechanism 18 or 20. In this regard, first weight-actuated spring assembly 18 may include a weight-actuating plate 66 configured to attach to link assembly 56, an input weighted cam 68 connected to a spring 72 by means of a spring guide rod 74, and an output weighted cam 70 connectable to a spring 76 by means of a spring guide rod 78. Output weighted cam 70 may be configured to connect directly or indirectly via suitable means to first output-actuating member 22. Note that, as defined and used herein, the term "weighted cam" generally refers to any suitable element that could be configured to function in the manner described herein, and is not limited in form as disclosed.

Figure 6:
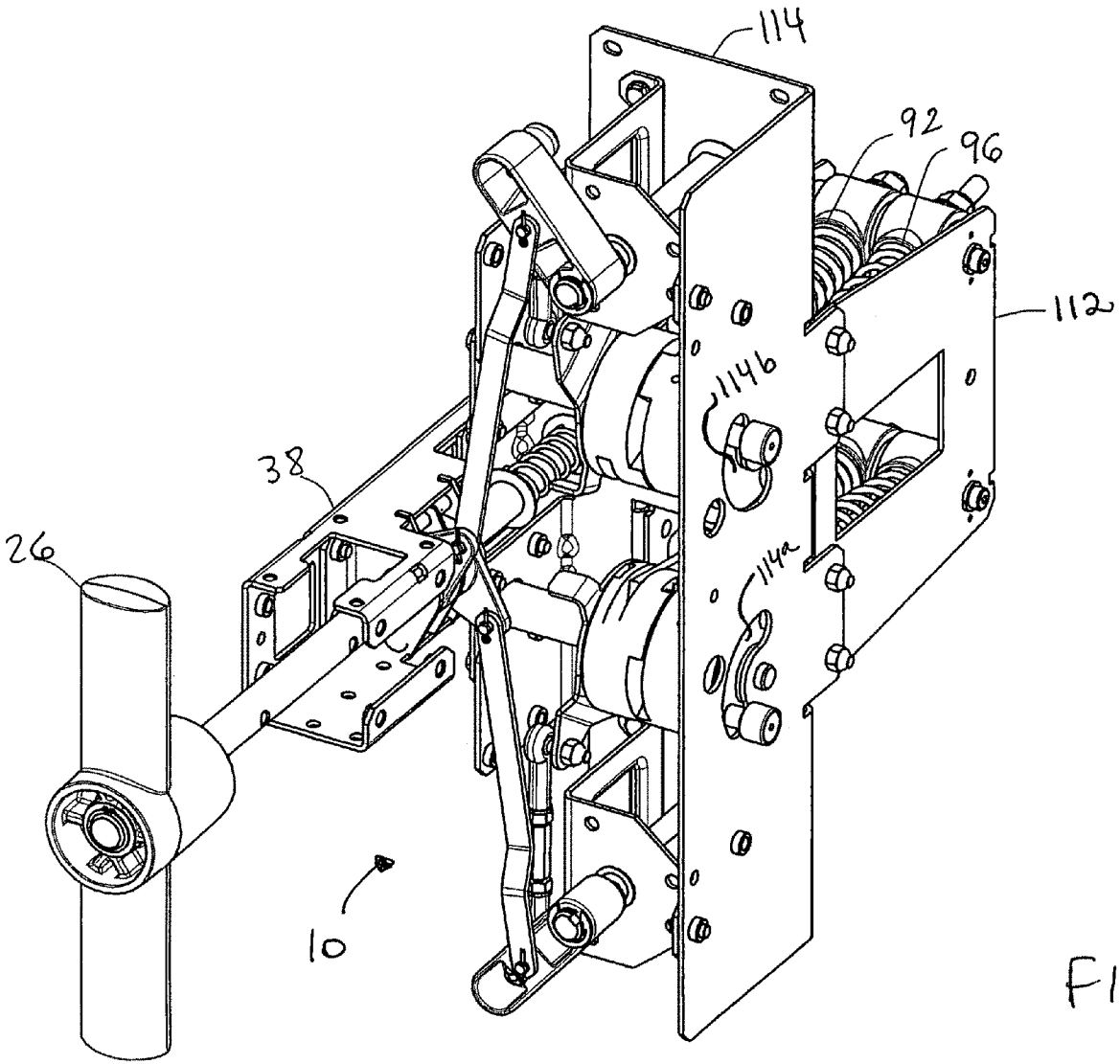
FIG. 6 illustrates the disclosed three-position apparatus of FIG. 1, including a shaft frame, a spring frame, and an apparatus frame.

Additionally, each of spring guide rods 74 and 78 may be supported on a spring pivot shaft 80 and positioned within spring pivot bearings 82 and 84. Spring pivot shaft 80 may be, in turn, mounted within a spring frame 112 supporting the weight-actuated spring mechanisms, as shown in FIG. 6, along with shaft frame 38 and an apparatus frame 114. As further shown in FIG. 6, apparatus frame 114 may include slots 114*a* and 114*b* for accommodating first output-actuating member 22 and second output-actuating member 24, respectively (note that, for clarity, only some of the apparatus components are denoted in FIG. 6). In general, the example frame assemblies illustrated in FIG. 6 may also facilitate incorporating three-position apparatus 10 into another system, such as an electrical transfer switch.

Second weight-actuated spring mechanism 20 may include substantially the same or similar components as the first weight-actuated spring mechanism 18. Accordingly, second weight-actuated spring mechanism 20 may include a weight-actuating plate 86 configured to attach to link assembly 64, an input weighted cam 88 connectable to a spring 92 by means of a spring guide rod 94, and an output weighted cam 90 connectable to a spring 96 by means of a spring guide rod 98. Further, each of the spring guide rods 94 and 98 may be supported on a spring pivot shaft 100 and positioned within spring pivot bearings 102 and 104. Spring pivot shaft 100 may be, in turn, mounted within spring frame 112 supporting the weight-actuated spring mechanisms.

Figure 4:
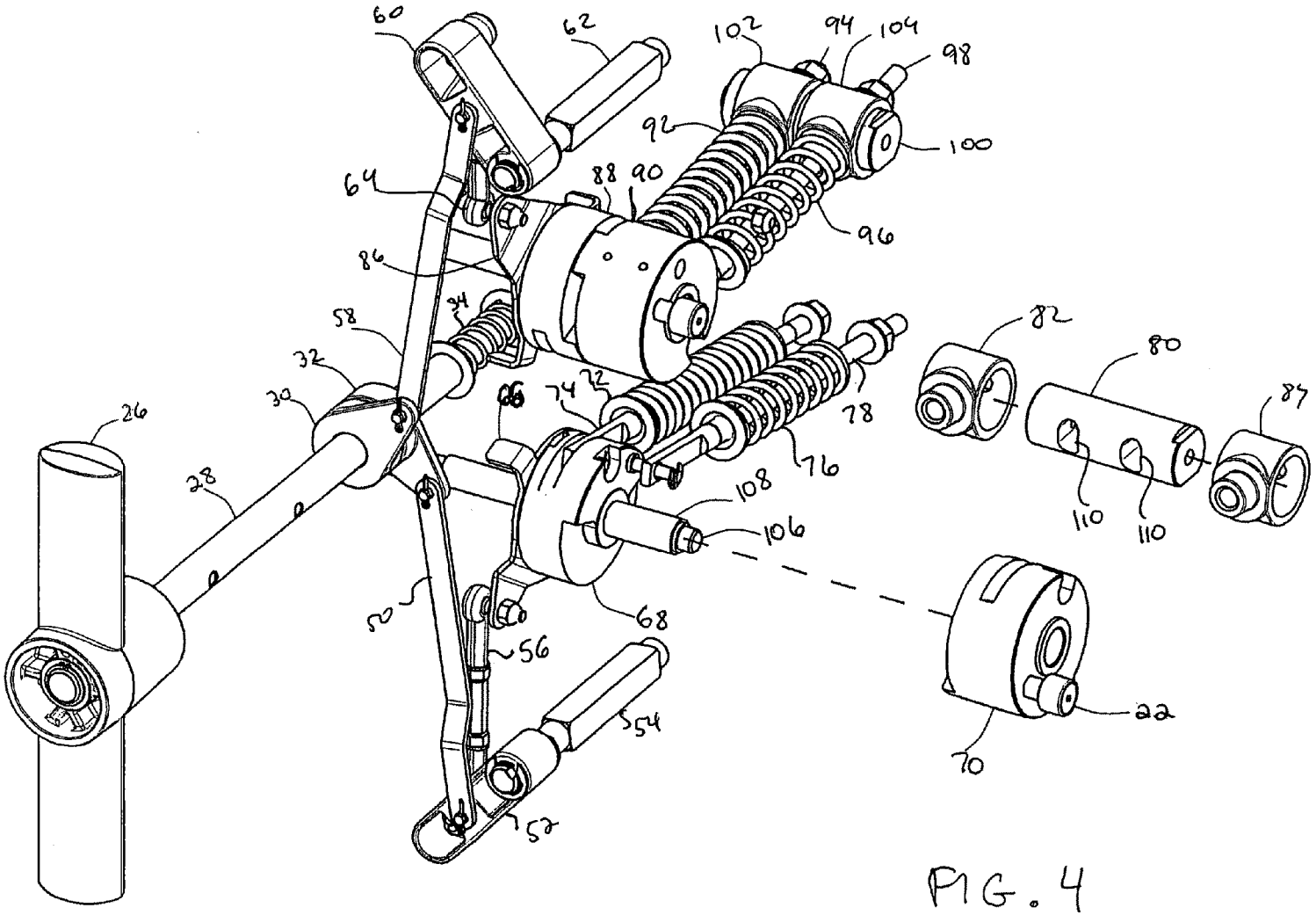
FIG. 4 illustrates the disclosed three-position apparatus of FIG. 1, including a partially exploded view of a representative weight-actuated spring mechanism.
Figure 5:
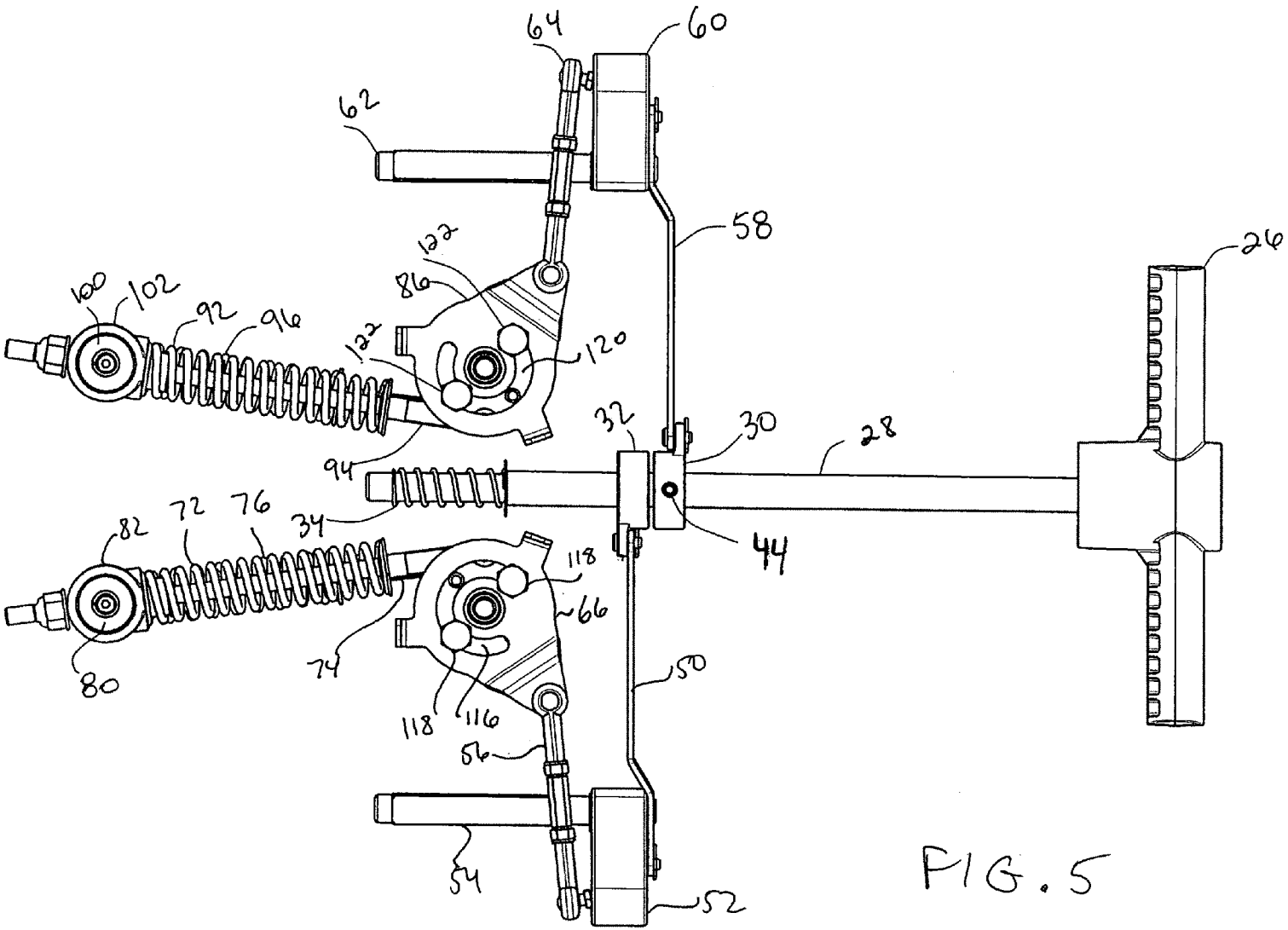

FIGS. 4 and 5 depict additional details with respect to weight-actuated spring mechanisms 18 and 20 and link mechanisms 14 and 16. More particularly, FIG. 4 illustrates, among others, a partially exploded view of representative weight-actuated spring mechanism 18. FIG. 5 then illustrates a side view of three-position apparatus 10 arranged in accordance with an embodiment. As illustrated in FIG. 4, both weighted cams 68 and 70 may be held in place and rotate about a weight shaft and weight bearings, such as a weight shaft 106 and weight bearings 108, respectively. Further, a spring pivot shaft, such as spring pivot shaft 80, may have openings 110 for accommodating spring rod guides, e.g., spring rod guides 74 and 78.

Referring now to FIG. 5, weight-actuating plate 66 may include a slot 116 accommodating bolts 118 coupled to input weighted cam 68. As input weighted cam 68 and weight-actuating plate 66 rotate with respect to each other about weight shaft 106, bolts 112 can move within slot 116 to selectively engage or disengage input weighted cam 68 and weight-actuating plate 66. Similarly, weight-actuating plate 86 includes a slot 120 accommodating bolts 122 coupled to input weighted cam 88. As input weighted cam 88 and weight-actuating plate 86 rotate with respect to each other, bolts 122 can move within slot 120 to selectively engage or disengage input weighted cam 88 and weight-actuating plate 86.

2. Apparatus Operation

In the illustrative arrangement, three-position apparatus 10 may be adapted for use with a system that is designed to operate in at least three distinct positions, such as an electrical transfer switch. In one particular arrangement, the disclosed three-position apparatus may be advantageously integrated into the type of an electrical transfer switch that has two separate sets of electrical contacts (e.g., in the form of two separate moveable contact assemblies) that each control a connection to a given power source. As noted above, one example of such electrical transfer switch is a dual-shaft electrical transfer switch having two separate contact-shaft assemblies, where each contact-shaft assembly comprises a respective set of electrical contacts that can be closed or open to respectively make or break an electrical connection to a given power source.

Figure 7:
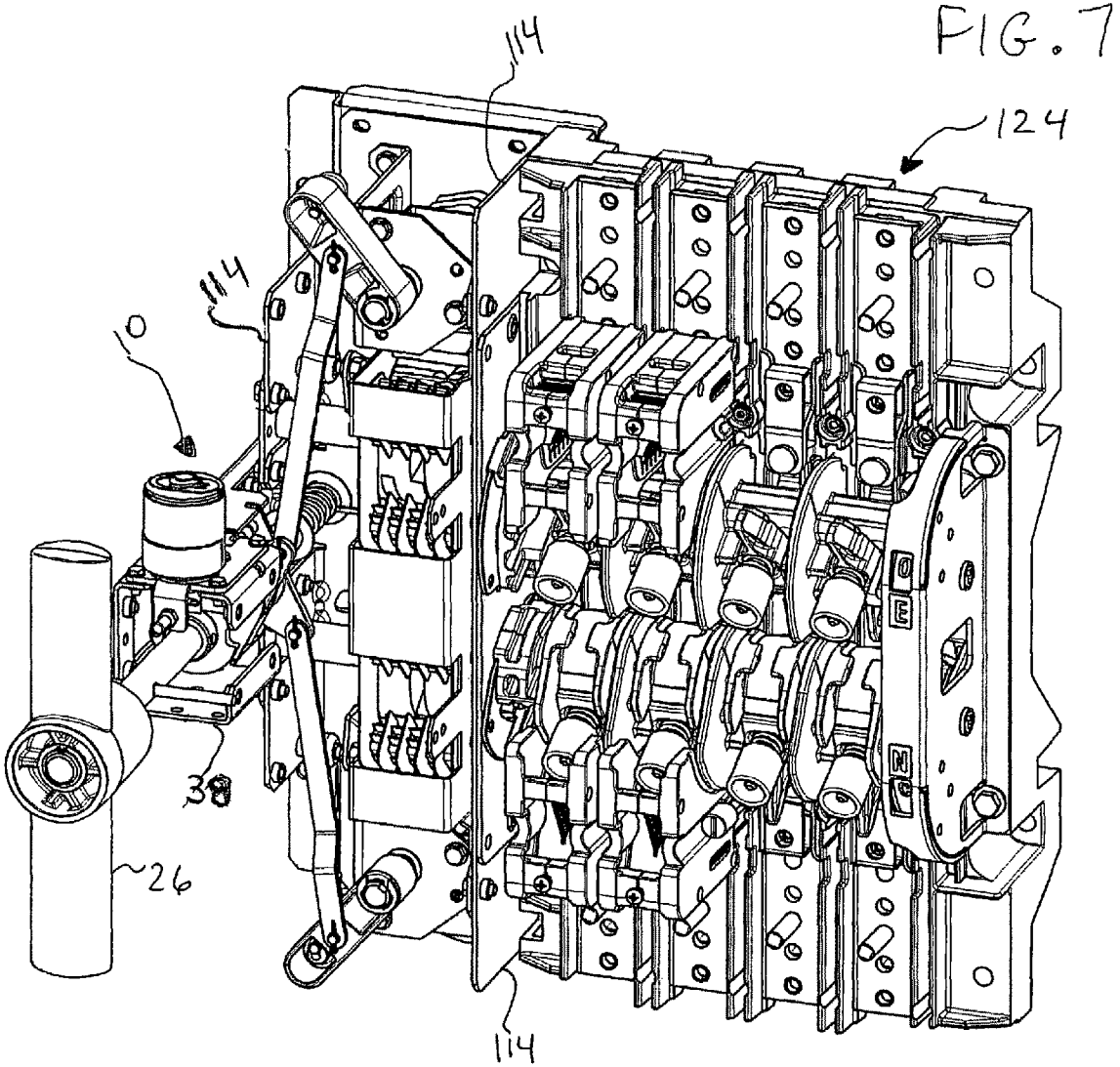
FIG. 7 illustrates the disclosed three-position apparatus of FIG. 1 as being used with a dual-shaft electrical transfer switch.
Figure 8:
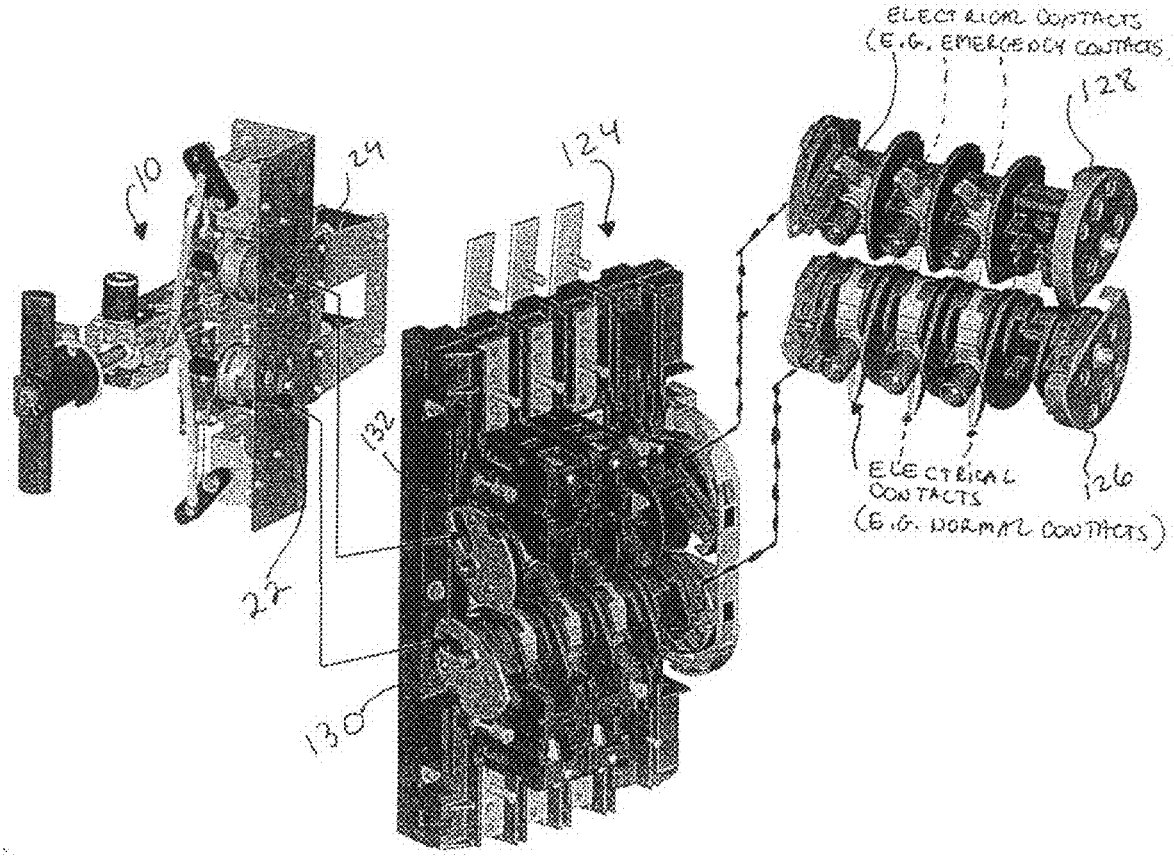
FIG. 8 illustrates the disclosed three-position apparatus and the dual-shaft electrical transfer switch of FIG. 7, including details of exemplary contact-shaft assemblies.
Figure 8:
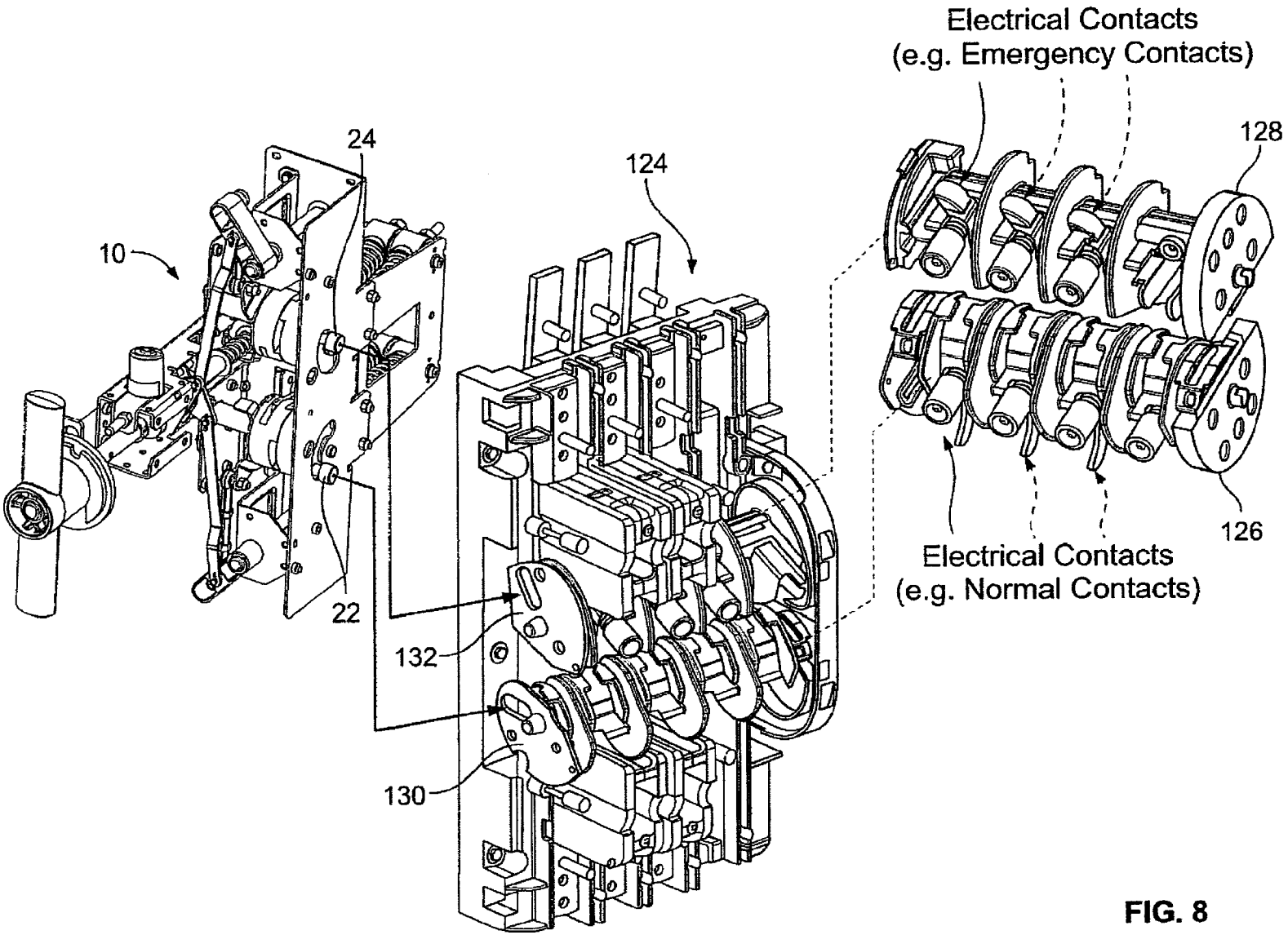

For example, a dual-shaft electrical transfer switch may include a first set of contacts (e.g., a "normal" set of contacts) for controlling a connection to a first ("normal") power source and a second set of electrical contacts (e.g., an "emergency" set of contacts) for controlling a connection to a second ("emergency") power source. FIGS. 7 and 8 generally depict one example of three-position apparatus 10 being used with a dual-shaft electrical transfer switch 124 having a first moveable contact-shaft assembly 126 for controlling a connection to a "normal" power source and a second moveable contact-shaft assembly 128 for controlling a connection to an "emergency" power source. Contact-shaft assemblies 126 and 128 are depicted more clearly in FIG. 8, which further illustrates three-position apparatus 10 and switch 124.

In the type of electrical transfer switch described above, the three distinct positions will typically include (i) a "normal" position with the normal set of contacts closed to connect an electrical load to a normal power source, (ii) an "emergency" position with the emergency set of contacts closed to connect the electrical load to the emergency power source, and (iii) an "open" in which both the normal and emergency set of contacts are open to disconnect the electrical load from either power source.

By way of example, to position switch 124 in the "normal" position, three-position apparatus 10 can operate to actuate first contact-shaft assembly 126 so as to close the normal set of contacts. Similarly, to position the switch in the "emergency" position, the three-position apparatus could operate to actuate second contact-shaft assembly 128 so as to close the emergency set of contacts. Similarly, the three-position apparatus could further operate to actuate either the first moveable contact-shaft assembly or the second moveable contact-shaft assembly (depending on whether the switch is currently in the "emergency" or "normal" position) so as to open a respective set of contacts to position the switch in the "open" position.

In general, a given set of switch contacts could be closed or opened in order to position switch 124 in a desired position by actuating position-selection mechanism 12. To achieve the desired position, position-selection mechanism 12 may be arranged to selectively control (i) a first portion of the three-position apparatus comprising first link mechanism 14, first weight-actuated spring mechanism 18, and first output actuating member 22, and (ii) a second portion of the three-position apparatus comprising second link mechanism 16, second weight-actuated spring mechanism 20, and second output actuating member 24. By way of example, the first portion of the three-position apparatus could be a "normal" portion used for opening and closing of a normal set of contacts of the switch, while the second portion of the three-position apparatus could be an "emergency" portion used for opening and closing of an emergency set of contacts of the switch. As those of ordinary skill in the art will recognize, alternative arrangements may be possible as well.

In operation, the "normal" or "emergency" portion of three-position apparatus 10 may be selected for activation by positioning operating handle 26 in a pushed-in or pulled-out position and subsequently rotating the handle. More specifically, in the embodiment illustrated in FIG. 1, to select the "normal" position and thereby close the normal set of contacts, operating handle 26 is pushed in and rotated in a counterclockwise direction by approximately 90 degrees in the plane perpendicular to the handle shaft 28. One benefit of arranging operating handle 26 to rotate in this manner is that the operating handle may be positioned on the outside of an enclosure housing an electrical transfer switch and three-position apparatus 10 (e.g., the operating handle may protrude through a slot in the housing), such that a human operator can actuate the apparatus without a need to open the housing, thus avoiding a potential personal injury.

A. Open and Normal Positioning

In one example, output-actuating member 22 may be in a first position that corresponds to an "open" position of the three-position apparatus 10. When operating handle 26 is oriented properly and pushed in, pin 44 (as shown in FIG. 3) moves through slot 46 toward positioning yoke 32 to engage positioning yoke 32 via slot 48. Further, as handle shaft 28 is rotated by means of the operating handle, pin 44 may be positioned substantially perpendicular with respect to the handle shaft to prevent forward or backward motion of the handle shaft 28, and to thereby "lock" the operating handle in place against the rear surface of intermediate plate 36. This locking also prevents a user from operating the three-position apparatus 10 to simultaneously engage positioning yoke 30 when positioning yoke 32 is engaged and the shaft is turned. Thus, once a user has utilized operating handle to engage and turn yoke 32 (and thus to drive output-actuating member 22), the user may not utilize the operating handle to engage yoke 30 (for the purposes of driving output-actuating member 24) without first returning the three-position apparatus 10 to its "open" position. This prevents a user from concurrently driving both output-actuating member 22 and output-actuating member 24.

As the operating handle 26 is pushed in and rotated in the counterclockwise direction, positioning yoke 32 rotates along with handle shaft 28 and actuates first link mechanism 14 attached to positioning yoke 32. When actuated, first link mechanism 14 is configured such that link 50, lever 52, and link assembly 56 working in concert cause the rotation of input-weight actuation plate 66. Effectively, first link mechanism 14 "converts" the rotational motion of the operating handle 26 into the rotational motion of input-weight actuation plate 66. Further, when the operating handle is rotated, input-weight actuation plate 66, via the mechanical coupling provided by bolts 118, rotates input weighted cam 68.

As input weighted cam 68 rotates, the site at which input weighted cam 68 and spring guide rod 74 are joined (the first cam-rod interface) is also rotated. More specifically, this first cam-rod interface rotates towards the spring pivot shaft 80, causing the compression of input spring 72 "about" spring guide rod 74. This compression of input spring 72 occurs until rotation of input weighted cam 68 brings the first cam-rod interface to its minimum distance from spring pivot shaft 80, and the "top dead center" is reached. At this position the "activation point" of the first weight-actuated spring mechanism 18 is reached. As input weighted cam 68 continues to rotate past "top dead center", input spring 72 finishes compressing and begins to discharge. During its discharge, input spring 72 begins to quickly drive the continued rotation of input weighted cam 68. In addition, past "top dead center" bolts 118 are free to move in slot 116 such that the input-weight actuation plate 66 is disengaged from input weighted cam 68, thereby allowing input weighted cam 68 to rotate freely and independent from the position of operating handle 26.

Before input spring 72 is completely discharged, the rotating input weighted cam 68 engages output weighted cam 70 with mechanical impact so that the two weighted cams rotate together. The induced rotation of output weighted cam 70 also causes output spring 76 to "charge," or to compress about output spring guide rod 78. In this regard, the input and output weighted cams 68 and 70 may be arranged accordingly, such that the weighted cams can "interlock" with one another at set respective rotational positions. For example, in an embodiment, as shown in FIGS. 1 and 4 for instance, each weighted cam may have a suitable cut-out from its body so that one weighted cam can engage another weighted cam when properly rotationally positioned with respect to each other. In other examples, the weighted cams may be arranged differently to achieve the same functionality.

As input weighted cam 68 and output weighted cam 70 rotate together, output spring 76 is compressed until the output weighted cam 70 reaches its "top dead center" position and begins to discharge. At that point, output spring 76 begins to quickly drive the continued rotation of output weighted cam 70. Also, after passing top dead center position, the output weighted cam 70 disengages from input weighted cam 68 while output spring 76 continues to rotate output weighted cam 70. As the output weighted cam 70 completes the rotation, first output-actuating member 22 is moved to a second position. Where the three-position actuator 10 is used to drive a dual-shaft electrical transfer switch (as shown in FIGS. 7 and 8) output-actuating member 22 actuates first moveable contact-shaft assembly 126, causing the normal set of contacts to close, thereby positioning switch 124 in the "normal"

position. For example, as shown in FIG. 8, first output-actuating member 22 may be arranged to move first moveable contact-shaft assembly 126 via a shaft plate 130 so as to close the normal set of contacts. Further, when in a discharged condition, output spring 76 holds the switch contacts in the mechanically locked toggle position, since the output spring 76 will not allow further rotation of output weighted cam 70.

In the illustrative embodiment, the size/mass of each spring/weighted cam of first weight-actuated spring mechanism 18 may be selected accordingly to general principles of force and mass such that a desired speed (and required force) at which switch contacts are closed and open is achieved. For example, for a given switch frame size, first weight-actuated spring mechanism 18 may be configured such that the speed generated by first weight-actuated spring mechanism 18 is substantially equivalent to the speed of an electrically-actuated apparatus.

B. Open and Emergency Positioning

With three-position apparatus 10 in the "normal" position, to position switch 124 in the "emergency" position (e.g., during a power failure of a normal power source), operating handle 26 is rotated in a clockwise direction by approximately 90 degrees in the plane perpendicular to handle shaft 28 to open the normal set of contacts, thereby first positioning the switch in the "open" position. As the operating handle is rotated, the "normal" portion of the three-position apparatus operates as described above, except that first output-actuating member 22 actuates first moveable contact-shaft assembly 126 to open the switch contacts. Further, rotating the operating handle clockwise repositions pin 44 such that the pin can slide through slot 46 and move toward positioning yoke 30 to engage positioning yoke 30.

According to an illustrative embodiment, with three-position apparatus 10 in the "open" position as shown in FIG. 1, to select the "emergency" position and thereby close the emergency set of contacts, operating handle 26 is pulled out. The operating handle 26 is then rotated in a clockwise direction by approximately 90 degrees in the plane perpendicular to the handle shaft 28. In effect, the operating handle completes approximately a 180-degree rotation to bring switch 124 from the "normal" position to the "emergency" position. When operating handle 26 is oriented properly and pulled out, pin 44 moves through slot 46 toward positioning yoke 30 to engage positioning yoke 30 via a slot (not shown) in positioning yoke 30. Further, as handle shaft 28 is rotated by means of the operating handle, pin 44 may be positioned substantially perpendicular with respect to the handle shaft to "lock" the operating handle in place against the front surface of intermediate plate 36.

In one preferred arrangement, position-selection mechanism 12 may include biasing spring 34 (e.g., a compression spring) to facilitate positioning handle 26 in a pulled-out position. More specifically, handle shaft 28 may be spring-loaded with biasing spring 34 such that the biasing spring pushes the handle out when the apparatus is in the "open" position. In effect, biasing spring 34 forces the operating handle to remain in the pulled-out position (e.g., as shown in FIG. 5, where operating handle is in a pulled-out position with pin 44 engaged within positioning yoke 30). This can eliminate the need to pull out the operating handle, thus allowing for a quicker transfer to the "emergency" position.

As the operating handle 26 is rotated in the clockwise direction, positioning yoke 30 rotates along with handle shaft 28 and actuates second link mechanism 16 attached to positioning yoke 30. When actuated, second link mechanism 16 is configured such as to cause rotation of input-weight actuation plate 86. Effectively, second link mechanism 16 "converts" the rotational motion of the operating handle 26 into the rotational motion of input-weight actuation plate 86 about an axis that may be substantially perpendicular to a plane in which the operating handle rotates. Further, when operating handle 26 is pulled out and rotated, input-weight actuation plate 86 in turn rotates input weighted cam 88.

As input weighted cam 88 rotates, the site at which input weighted cam 88 and spring guide rod 94 are joined (the second cam-rod interface) is also rotated. More specifically, this second cam-rod interface rotates towards the spring pivot shaft 100, causing the compression of input spring 92 "about" spring guide rod 94. This compression of input spring 92 occurs until rotation of input weighted cam 88 brings the second cam-rod interface to its minimum distance from spring pivot shaft 100, and the "top dead center" is reached. At this position the "activation point" of the second weight-actuated spring mechanism 20 is reached. As input weighted cam 88 continues to rotate past "top dead center", input spring 92 finishes compressing and begins to discharge. During its discharge, input spring 92 begins to quickly force the continued rotation of input weighted cam 88. In addition, past "the top dead center" bolts 122 are free to move in slot 120 such that the input-weight actuation plate 86 is disengaged from input weighted cam 88, thereby allowing input weighted cam 88 to rotate freely and independent from the position of operating handle 26.

Before input spring 92 is completely discharged, the rotating input weighted cam 88 engages output weighted cam 90 with mechanical impact so that the two weighted cams rotate together. The induced rotation of output weighted cam 90 also causes output spring 96 to "charge," or to compress about output spring guide rod 98. In this regard, the input and output weighted cams 88 and 90 may be arranged accordingly, such that the weighted cams can "interlock" with one another at set respective rotational positions. For example, in an illustrative embodiment, as shown in FIGS. 1 and 4 for instance, each weighted cam may have a suitable cut-out from its body so that one weighted cam can engage another weighted cam when properly rotationally positioned with respect to each other. In other examples, the weighted cams may be arranged differently to achieve the same functionality.

As input weighted cam 88 and output weighted cam 90 rotate together, output spring 96 is compressed until the output weighted cam 90 reaches its "top dead center" position and begins to discharge. At that point, output spring 96 begins to quickly drive the continued the rotation of output weighted cam 90. Also, after passing top dead center position, the output weighted cam 90 disengages from input weighted cam 88 while output spring 96 continues to rotate output weighted cam 90. As the output weighted cam 90 completes the rotation, second output-actuating member 24 is moved to a "closed" position. The three-position actuator 10 may be used to drive a dual-shaft electrical transfer switch (as shown in FIGS. 7 and 8) output-actuating member 24 actuates second moveable contact-shaft assembly 128, causing the emergency set of contacts to close, thereby positioning switch 124 in the "emergency" position. For example, as shown in FIG. 8, second output-actuating member 24 may be arranged to move second moveable contact-shaft assembly 128 via a shaft plate 132 to close the emergency set of contacts. Further, when in a discharged condition, output spring 96 holds the switch contacts in the mechanically locked toggle position, since the output spring will not allow further rotation of output weighted cam 90.

In the illustrative arrangements, the size/mass of each spring/weighted cam of second weight-actuated spring mechanism 20 may be selected accordingly to general principles of force and mass such that a desired speed (and required force) at which switch contacts are closed and open is achieved. For example, for a given switch frame size, second weight-actuated spring mechanism 20 may be configured such that the speed generated by second weight-actuated spring mechanism 20 may be substantially equivalent to a speed of an electrically-actuated apparatus.

With three-position apparatus 10 in the "emergency" position, to return switch 124 to the "normal" position (e.g., when normal power source is restored), operating handle 26 is rotated in a counter-clockwise direction by approximately 90 degrees in the plane perpendicular to handle shaft 28 to open the emergency set of contacts, thereby first positioning the switch in the "open" position. As the operating handle is rotated, the "emergency" portion of the three-position apparatus operates as described above, except that second output-actuating member 24 actuates second moveable contact-shaft assembly 128 to open the switch contacts. Further, rotating the operating handle clockwise repositions pin 44 such that the pin can slide through slot 46 and move toward positioning yoke 32 to engage positioning yoke 32.

With three-position apparatus 10 in the "open" position, operating handle 26 may then be pushed in and rotated in a counter-clockwise direction by approximately 90 degrees in the plane perpendicular to the handle shaft 28. Thus, in effect, the operating handle completes approximately a 180-degree rotation to bring switch 124 from the "emergency" position to the "normal" position. The "normal" portion of the three-position apparatus operates as described above to position the switch in the "normal" position.

Note that, with a benefit of the disclosed embodiments, three-position apparatus 10 is arranged such that the normal set contacts 126, as independently controlled by the "normal" portion of the apparatus, and the emergency set of contacts 128, as independently controlled by the "emergency" portion of the apparatus, cannot be closed at the same time.

Arrangements of the present application have been described above. Those skilled in the art will understand, however, that changes and modifications may be made to these arrangements without departing from the true scope and spirit of the present application, which is defined by the claims.

Further, the examples in the above description and figures are set forth in the context of the disclosed three-position apparatus being used in conjunction with an electrical transfer switch (e.g., a dual-shaft electrical transfer switch), but the described methods and apparatus could be used by any system operated in at least three distinct positions and not only those disclosed in the above examples. As just one example, the disclosed three-position apparatus could be used with a switch other than an electrical transfer switch.

I claim:

1. Multi-position apparatus for use with a system operated in distinct positions, the multi-position apparatus comprising in combination:

a position-selection mechanism;

a first link mechanism and a second link mechanism, each link mechanism being operably coupled with the position-selection mechanism;

a first weight-actuated spring mechanism operably coupled with the first link mechanism;

a second weight-actuated spring mechanism operably coupled with the second link mechanism;

a first output-actuating member operably coupled with the first weight-actuated spring mechanism, the first output-actuating member being arranged to operably communicate with the system; and a second output-actuating member operably coupled with the second weight-actuated spring mechanism, the second output-actuating member being arranged to operably communicate with the system, wherein the multi-position apparatus is configured to position the system in the distinct positions.

2. The apparatus of claim 1, wherein the system includes a first moveable assembly and a second moveable assembly, and wherein the first output-actuating member actuates the first movable assembly to position the system in at least a first of the distinct positions, and wherein the second output-actuating member actuates the second moveable assembly to position the system into at least a second of the distinct positions.

3. The apparatus of claim 1, wherein the system is an electrical transfer switch.

4. The apparatus of claim 3, wherein the electrical transfer switch is positioned in one or more of the distinct positions such as to transfer an electrical load from one power source to another power source.

5. The apparatus of claim 1, wherein the position-selection mechanism includes a manually-actuated means.

6. The apparatus of claim 5, wherein the manually-actuated means includes a handle, and wherein the handle is rotated to select a given one of the distinct positions.

7. The apparatus of claim 6, wherein the handle is further positioned in a pushed-in or pulled-out position to select the given one of the distinct positions.

8. The apparatus of claim 7, wherein the position-selection mechanism further includes a biasing spring that assists in positioning the handle in the pulled-out position.

9. The apparatus of claim 3, wherein the manually-actuated means includes a rotatable handle, a handle shaft carrying a first positioning yoke and a second positioning yoke, and wherein the first positioning yoke actuates the first link mechanism in response to the handle being rotated so as to position the system into at least a first of the distinct positions, and wherein the second positioning yoke actuates the second link mechanism in response to the handle being rotated so as to position the system into at least a second of the distinct positions.

10. The apparatus of claim 9, wherein the first weight-actuated spring mechanism includes a first weight-actuation plate operably coupled to the first link mechanism, a first weighted cam operably coupled with the first weight-actuation plate, a second weighted cam, a first spring operably coupled with the first weighted cam, and a second spring operably coupled with the second weighted cam, and wherein when the first positioning yoke actuates the first link mechanism, the first weight-actuation plate causes the first weighted cam to rotate and charge the first spring, and wherein when the first spring discharges, the first weighted cam rotates and engages the second weighted cam such that the second weighted cam rotates together with the first weighted cam to charge the second spring.

11. The apparatus of claim 10, wherein when the first spring discharges, the first weighted cam freely rotates.

12. The apparatus of claim 10, wherein when the second spring discharges, the second weighted cam disengages from the first weighted cam and rotates independently from the first weighted cam, and wherein the first output-actuating member actuates the system as the second weighted cam rotates.

13. The apparatus of claim 10, wherein when the first positioning yoke actuates the first link mechanism, the first weight-actuation plate rotates about an axis perpendicular to a plane in which the handle rotates.

14. The apparatus of claim 9, wherein the second weight-actuated spring mechanism includes a second weight-actuation plate coupled to the second link mechanism, a third weighted cam operably coupled with the second weight-actuation plate, a fourth weighted cam, a third spring operably coupled with the third weighted cam, and a fourth spring operably coupled with the fourth weighted cam, and wherein when the second positioning yoke actuates the second link mechanism, the second weight-actuation plate causes the third weighted cam to rotate and charge the third spring, and wherein when the third spring discharges, the third weighted cam rotates and engages the fourth weighted cam such that the fourth weighted cam rotates together with the third weighted cam to charge the fourth spring.

15. The apparatus of claim 14, wherein when the third spring discharges, the third weighted cam freely rotates.

16. The apparatus of claim 14, wherein when the fourth spring discharges, the fourth weighted cam disengages from the third weighted cam and rotates independently from the third weighted cam, and wherein the second output-actuating member actuates the system as the fourth weighted cam rotates.

17. The apparatus of claim 14, wherein when the second positioning yoke actuates the second mechanism, the second weight-actuation plate rotates about an axis perpendicular to a plane in which the handle rotates.

18. A multi-position apparatus for use with an electrical transfer switch having two separate sets of electrical contacts, the multi-position apparatus comprising in combination:

a position-selection mechanism;

a first link mechanism and a second link mechanism, each link mechanism being operably coupled with the position-selection mechanism;

a first weight-actuated spring mechanism operably coupled with the first link mechanism;

a second weight-actuated spring mechanism operably coupled with the second link mechanism;

a first output-actuating member operably coupled with the first weight-actuated spring mechanism, the first output-actuating member being arranged to operably communicate with the switch such as to actuate opening and closing of a first set of electrical contacts of the switch; and a second output-actuating member operably coupled with the second weight-actuated spring mechanism, the second output-actuating member being arranged to operably communicate with the switch such as to actuate opening and closing of a second set of electrical contacts of the switch, wherein the multi-position apparatus is configured to position the switch in distinct positions.

19. The apparatus of claim 18, wherein the distinct positions consist of (i) a first position with the first set of electrical contacts being closed, (ii) a second position with the second set of electrical contacts being closed, and (iii) a third position with the first and second sets of contacts being open.

20. The apparatus of claim 18, wherein the electrical transfer switch is a dual-shaft electrical switch.

21. The apparatus of claim 19, wherein the dual-shaft electrical transfer switch includes a first moveable contact-shaft assembly and a second moveable contact-shaft assembly, and wherein the first output-actuating member is arranged to operably communicate with the first moveable contact-shaft assembly such as to actuate opening and closing of the first set of electrical contacts of the switch, and wherein the second output-actuating member is arranged to operably communicate with the second moveable contact-shaft assembly such as to actuate opening and closing of the second set of electrical contacts of the switch.

22. The apparatus of claim 18, wherein each of the first and second weight-actuated spring mechanisms is configured such as to achieve opening and closing of a respective set of electrical contacts of the switch at a given speed.

23. A three-position apparatus for use with an electrical transfer switch having two separate sets of electrical contacts, the three-position apparatus comprising in combination:

a manually-actuated means;

a first link mechanism and a second link mechanism, each link mechanism being operably coupled with the position-selection mechanism;

a first weight-actuated spring mechanism operably coupled with the first link mechanism, the first weight-actuated spring mechanism including at least a first weighted cam, a second weighted cam, a first spring, and a second spring;

a second weight-actuated spring mechanism operably coupled with the second link mechanism, the second weight-actuated spring mechanism including at least a third weighted cam, a fourth weighted cam, a third spring, and a fourth spring;

a first output-actuating member operably coupled with one of the first and second weighted cams, the first output-actuating member being arranged to operably communicate with the switch such as to actuate opening and closing of a first set of electrical contacts of the switch; and a second output-actuating member operably coupled with one of the third and fourth weighted cams, the second output-actuating member being arranged to operably communicate with the switch such as to actuate opening and closing of a second set of electrical contacts of the switch, wherein the three-position apparatus is configured to position the switch in three distinct positions.

* * * * *

UNITED STATES PATENT AND TRADEMARK OFFICE

CERTIFICATE OF CORRECTION

PATENT NO. : 7,667,154 B2
APPLICATION NO. : 11/784662
DATED : February 23, 2010
INVENTOR(S) : Walter Dolinski It is certified that error appears in the above-identified patent and that said Letters Patent is hereby corrected as shown below:

IN THE DRAWINGS:

Delete Figure 8 and replace with attached Figure 8.

Signed and Sealed this

Twenty-third Day of November, 2010

David J. Kappos

David J. Kappos
*Director of the United States Patent and Trademark Office*